US006287686B1

(12) United States Patent
Huang et al.

(10) Patent No.: US 6,287,686 B1
(45) Date of Patent: Sep. 11, 2001

(54) FIRE RETARDANT AND HEAT RESISTANT YARNS AND FABRICS MADE THEREFROM

(75) Inventors: Tsai Jung Huang, Tai-Chung (TW); William J. Hanyon, Salt Lake City; Michael R. Chapman, Bountiful, both of UT (US)

(73) Assignee: Chapman Thermal Products, Inc., Woods Cross, UT (US)

( * ) Notice: Subject to any disclaimer, the term of this patent is extended or adjusted under 35 U.S.C. 154(b) by 0 days.

(21) Appl. No.: 09/583,499

(22) Filed: May 31, 2000

(51) Int. Cl.[7] ..... D01F 6/00

(52) U.S. Cl. ..... 428/362; 428/370; 428/365; 428/377

(58) Field of Search ..... 428/365, 370, 428/362, 394, 377, 373

(56) References Cited

U.S. PATENT DOCUMENTS

| | | | |
|---|---|---|---|
| 4,031,188 | 6/1977 | Kohler | 423/447.6 |
| 4,081,498 | 3/1978 | Maranci | 260/898 |
| 4,331,729 | 5/1982 | Weber | 428/252 |
| 4,365,655 | 12/1982 | Feinberg | 139/426 |
| 4,865,906 | 9/1989 | Smith, Jr. | 428/224 |
| 4,902,561 | 2/1990 | McCullough, Jr. et al. | 428/280 |
| 4,987,664 | 1/1991 | McCullough, Jr. et al. | 28/103 |
| 5,015,522 | 5/1991 | McCullough, Jr. et al. | 428/312.2 |
| 5,188,896 | 2/1993 | Suh et al. | 428/397 |
| 5,233,736 | 8/1993 | Hill | 28/265 |
| 5,275,875 | 1/1994 | Suh et al. | 428/292 |
| 5,356,707 | 10/1994 | McCullough, Jr. et al. | 428/367 |
| 5,582,912 | 12/1996 | McCullough, Jr. et al. | 428/367 |
| 5,688,577 | 11/1997 | Smith et al. | 428/113 |
| 6,021,523 | 2/2000 | Vero | 2/159 |

OTHER PUBLICATIONS

"The Curlon™ Story", published at www.orcon.com/aerospace/curlon.html, May 5, 2000, pp. 1 and 2.

"FAA Tests Show New Materials Double Fuselage Burn-through Times", FAA News, published at www.dot.gov/affairs/1996/apa7496.htm, May 6, 1996, pp. 1 and 2.

*Primary Examiner*—N. Edwards
(74) *Attorney, Agent, or Firm*—Workman, Nydegger & Seeley

(57) ABSTRACT

Fire retardant and heat resistant yarns, fabrics, felts and other fibrous blends which incorporate high amounts of oxidized polyacrylonitrile fibers. Such yarns, fabrics, felts and other fibrous blends have a superior LOI, TPP and continuous operating temperature, compared to conventional fire retardant fabrics. The yarns, fabrics, felts and other fibrous: blends are also more soft and supple, and are therefore more comfortable to wear, compared to conventional fire retardant fabrics. The yarns, fabrics, felts and other fibrous blends incorporate up to 99.9% oxidized polyacrylonitrile fibers, together with at least one additional fiber, such as p-aramid, in order to provide increased tensile strength and abrasion resistance of the inventive yarns, fabrics, felts and other fibrous blends. The yarns may be woven, knitted or otherwise assembled into a desired fabric.

20 Claims, No Drawings

FIRE RETARDANT AND HEAT RESISTANT YARNS AND FABRICS MADE THEREFROM

BACKGROUND OF THE INVENTION

1. The Field of the Invention

The present invention is in the field of fire retardant and heat resistant yarns and fabrics, felts, and other fibrous blends. More particularly, the present invention is in the field of fibrous blends which include oxidized polyacrylonitrile and one or more strengthening fibers and which yield yarns and fabrics having greatly increased LOI and TPP, while maintaining good strength, higher softness and other performance criteria.

2. The Relevant Technology

Fire retardant clothing is widely used to protect persons who are exposed to fire, particularly suddenly occurring and fast burning conflagrations. These include persons in diverse fields, such as race car drivers, military personnel and fire fighters, each of which may be exposed to deadly fires and extremely dangerous incendiary conditions without notice. For such persons, the primary line of defense against severe bums and even death is the protective clothing worn over some or all of the body.

Even though fire retardant clothing presently exists, such clothing is not always adequate to compensate for the risk of severe burns, or even death. Due to the limitations in fire retardance and heat resistance of present state of the art of fire retardant fabrics, numerous layers are typically worn, often comprising different fibrous compositions to impart a variety of different properties for each layer.

In view of the limitations of presently available fire retardant clothing, there has been a long-felt need to find improved yarns, fabrics, felts, and other fibrous blends having better fire retardant properties, higher heat resistance, lower heat transference, improved durability when exposed to constant heat or bursts of high heat, together with adequate strength and abrasion resistance, improved softness, better breathability, improved moisture regain, increased flexibility and comfort, and other performance criteria. Two useful measurements of flame retardance and heat resistance are the Limiting Oxygen Index (LOI) and the Thermal Protective Performance (TPP), which will be defined more filly below.

A wide variety of different fibers and fibrous blends have been used in the manufacture of fire and heat resistant yarns and fabrics. Fire retardance, heat resistance, strength and abrasion resistance all play an important role in the selection of fibers. However, it is difficult to satisfy all of the foregoing desired properties. For example, there is often a compromise between fire retardance and heat resistance, on the one hand, and strength and abrasion resistance, on the other.

Conventional fire retardant fabrics on the market typically rate very high in one, or perhaps two, of the foregoing desired properties. Nevertheless, until now, no one single fiber, fibrous blend or fabric was able to rate high in all, or even most, of the foregoing criteria. For example, the industry standard is currently exemplified by Nomex, which is a proprietary fabric comprising an m-aramid sold by DuPont. When exposed to temperatures of approximately 600° F. and higher, a fabric consisting of Nomex starts to burn, begins to shrink while charring, then cracks and decomposes. This all occurs in about ten seconds.

Whereas Nomex may provide protection to the wearer from burns for approximately ten seconds, which in many cases may be enough time to extinguish the fire or otherwise remove the heat from the wearer's clothing, Nomex nevertheless becomes almost completely worthless as a protective shield after 10 seconds of being exposed to heat at or above 600° F. Once the fabric has charred, cracked and begun to decompose, large holes will typically open up rough which flames and heat can pass, thus burning, or even charring, the naked skin of the person wearing the fabric. Ironically, it is the charring process of the fabric itself that is believed to give the wearer increased thermal protection.

Another flame retardant fabric known in the art is Kevlar, which is a p-aramid material. Whereas Kevlar is adequate in many applications, being durable in abrasion and having high tensile strength, it is relatively stiff, and uncomfortable to wear. In addition, while being superior to many known fibers, it has only modestly high LOI, TPP and continuous operating temperature ratings. Whereas is it self-extinguishing, it nevertheless combusts when exposed to a flame.

In many cases, the fire retardant properties of certain flammable fabrics such as cotton, polyester, rayon, and nylon, have been enhanced by adding a fire retardant finish to the fabric. While this may have the effect of temporarily increasing the flame retardant and heat resistant properties of a given fabric, such fire retardant finishes are not permanent. Exposure of the treated fabric to UV radiation over time, such as being exposed to sun light, as well as routine laundering of the fabric, can cause a reduction in the fire retardant properties of the garment. Not only will a treated garment have reduced fire retardance and heat resistance as the fire retardant finish becomes less effective, but the user may then have a false sense of security, thus unknowingly exposing himself to increased risk of burns. In fact, there may be no objective way to determine, short of being caught in a fiery conflagration or otherwise damaging the garment, whether a treated garment still possesses a high enough level of fire retardance to meet the risks to which the wearer may be exposed.

Accordingly, it would be an advancement in the art to provide improved fire retardant and heat resistant yarns, fabrics, felts and other fibrous blends which were able to satisfy most, if not all, of the desired performance criteria.

In particular, it would be a tremendous improvement in the art to provide improved fibrous blends that yielded fire and flame retardant yarns, fabrics, felts and other fibrous blends that were able to satisfy a wider range of performance criteria compared to conventional fire retardant fabrics.

It would be an additional advancement in the art to provide fire retardant yarns, fabrics, felts and other fibrous blends that had higher continuous operating temperatures, higher LOI and TPP ratings, and improved resistance to heat transfer, while having adequate strength, including tensile strength and abrasion resistance, as well as a softer, more flexible and comfortable feel when known against a person's skin compared to conventional fire retardant fabrics.

Such fire retardant yarns, fabrics, felts and other fibrous blends are disclosed and claimed herein.

SUMMARY AND OBJECTS OF THE INVENTION

The present invention encompasses novel yarns, fabrics, felts and other fibrous blends having greatly increased fire retardance and heat resistance. The yarns, fabrics, felts and other fibrous blends within the scope of the present invention include a relatively high concentration of oxidized polyacrylonitrile blended with one or more fibers selected to increase the tensile strength and abrasion resistance of the yarns, fabrics, felts and other fibrous blends. The yarn can be woven, knitted, or otherwise assembled into an appropriate fabric that can be used to make a wide variety of fire retardant and heat resistant articles of manufacture, including but not limited to, clothing, jump suits, gloves, socks, welding bibs, fire blankets, floor boards, padding, protective head gear, linings, undergarments, cargo holds, bedding, mattress insulation, drapes, insulating fire walls, and the like. The inventive felts, though considerably weaker than knitted or woven fabrics made from the inventive yarns, may be employed as an auxiliary layer to the fabrics, or as liners, underlayers, insulation and the like where high strength is not a serious factor.

In addition to having greatly increased fire retardant and heat resistant properties, the fabrics manufactured according to the present invention are typically much softer and flexible, and have a more comfortable feel, compared to the industry standard fire retardant fabrics. They also are more breathable and have superior water regain compared to the more fire retardant and heat resistant fabrics presently on the market.

The present invention combines the tremendous fire retardant and heat resistant characteristics of oxidized polyacrylonitrile with the strengthening and abrasion resistance offered by one or more additional fibers which are stronger but less fire retardant. These additional fibers may be referred to as "strengthening fibers" and include, but are not limited to, polybenzimidazole (PBI), polyphenylene-2, 6benzobisoxazole (PBO), modacrylic, p-aramid, m-aramid, polyvinyl halides, wool, fire resistant polyesters, fire resistant nylons, fire resistant rayons, cotton, and melamine.

The oxidized polyacrylonitrile fibers and the strengthening fibers are each first preferably carded into respective strands or carded together to form a blended strand. Multiple strands are then intertwined together to form a yarn. Alternatively, strands made from polyacrylonitrile and strengthening fibers, blended strands, or a combination thereof may be felted or otherwise formed into a non-woven mat or sheet.

In most cases, the quantity of oxidized polyacrylonitrile fibers is maximized while the quantity of strengthening fibers is minimized to that amount necessary to ensure adequate strength and abrasion resistance. It has been found, for example, that for every 1% of p-aramid fibers that are blended with oxidized polyacrylonitrile fibers, the strength of the resulting yarn is increased by about 10%. Thus, even though yarns containing pure oxidized polyacrylonitrile fibers are generally too weak to be used in the manufacture of fire retardant and heat resistant fabrics, yarns containing even a small percentage of strengthening fibers, and fabrics manufactured therefrom, have been found to be surprisingly strong, durable and abrasion resistant.

It is preferable for the inventive yarns according to the invention, which are used to manufacture inventive fabrics and other articles of manufacture according to the invention, to include oxidized polyacrylonitrile fibers in an amount in a range from about 85.5% to about 99.9% by weight of the fibers in the yarn. The oxidized polyacrylonitrile fibers will more preferably be included in an amount in a range from about 86% to about 99.5% by weight of the fibers in the yarn, even more preferably in an amount in a range from about 87% to about 99% by weight of the fibers in the yarn, and most preferably in range from about 90% to about 97% by weight of the fibers in the yarn.

Accordingly, the strengthening fibers that are blended with the oxidized polyacrylonitrile fibers are preferably included in an amount in a range from about 0.1% to about 14.5% by weight of the fibers in the yarn, more preferably in an amount in a range from about 0.5% to about 14% by weight of the fibers in the yarn, even more preferably in an amount in a range from about 1% to about 13% by weight of the fibers in the yarn, and most preferably in an amount in a range from about 3% to about 10% by weight of the fibers in the yarn.

Felts or other fibrous blends, such as blended strands, made according to the invention will typically include the same preferred ranges of oxidized polyacrylonitrile and strengthening fibers.

By maximizing the quantity of oxidized polyacrylonitrile fibers relative to the quantity of the strengthening fibers, it is possible to obtain yarns, fabrics, felts and other fibrous blends that possess superior fire retardant properties, higher heat resistance, lower heat transference, and improved durability when exposed to constant heat or bursts of high heat, together with adequate strength and abrasion resistance, improved softness, better breathability, improved moisture regain, increased flexibility and comfort, and other performance criteria compared to conventional fire retardant fabrics presently available in the market.

In view of the foregoing, it is an object of the invention to provide improved fire retardant and heat resistant yarns, fabrics, felts and other fibrous blends which are able to satisfy most, if not all, of the desired performance criteria.

It is a further object and feature of the invention to provide improved fibrous blends that yield fire and flame retardant yarns, fabrics, felts and other fibrous blends that are able to satisfy a wider range of performance criteria compared to conventional fire retardant fabrics and other fibrous blends.

It is another object of the invention to provide fire retardant yarns, fabrics, felts and other fibrous blends that have higher continuous operating temperatures, higher LOI and TPP ratings, and improved resistance to heat transfer, while having adequate strength, including tensile strength and abrasion resistance, as well as a softer, more flexible and comfortable feel when worn against a person's skin compared to conventional fire retardant fabrics and other fibrous blends.

These and other objects and features of the present invention will become more fully apparent from the following description and appended claims, or may be learned by the practice of the invention as set forth hereinafter.

DETAILED DESCRIPTION OF THE PREFERRED EMBODIMENTS

I. INTRODUCTION

The present invention relates to novel fire retardant and heat resistant yarns, fire retardant and heat resistant fabrics made therefrom, felts, and other fibrous blends. The yarns, fabrics, felts and other fibrous blends include a blend of fibers primarily comprising oxidized polyacrylonitrile fibers and one or more strengthening fibers. The oxidized polyacrylonitrile fibers impart high fire retardance and heat resistance, and the strengthening fibers impart tensile strength, tear strength and abrasion resistance to the yarns, fabrics and other fibrous blends. The inventive yarns can be woven, knitted, or otherwise assembled into appropriate fabrics used to make a wide variety of fire retardant and heat resistant articles of manufacture such as clothing, jump suits, gloves, socks, welding bibs, fire blankets, floor boards, padding, protective head gear, linings, undergarments, cargo holds, bedding, mattress insulation, drapes, insulating fire walls, and the like.

In general, the properties often considered desirable by persons who are exposed to fire and heat and who wear fire retardant fabrics include a high continuous operating temperature, high LOI, high TTP, low heat conductivity, maintenance of tensile strength and abrasion resistance over the life of the garment, particularly during and after exposure to high temperature, chemical resistance, softness, water regain and comfort. The fabrics manufactured according to the present invention are superior in most, if not all, of the foregoing properties.

The inventive felts, though considerably weaker than knitted or woven fabrics made from the inventive yarns, may be used in the manufacture of auxiliary layers to the fabrics, liners, underlayers, insulation and the like where high strength performance is less of a factor.

II. DEFINITIONS

In general, heat degrades fibers and fabrics at different rates depending on fiber chemistry, the level of oxygen in the surrounding atmosphere of the fire, and the intensity of fire and heat. There are a number of different tests used to determine a fabric's flame retardance and heat resistance rating, including the Limiting Oxygen Index, continuous operating temperature, and Thermal Protective Performance.

The term "Limiting Oxygen Index" (or "LOI") is defined as the minimum concentration of oxygen necessary to support combustion of a particular material. The LOI is primarily a measurement of flame retardancy rather than temperature resistance. Temperature resistance is typically measured as the "continuous operating temperature".

The term "continuous operating temperature" measures the maximum temperature, or temperature range, at which a particular fabric will maintain its strength and integrity over time when exposed to constant heat of a given temperature or range. For instance, a fabric that has a continuous operating temperature of 400° F. can be exposed to temperatures of up to 400° F. for prolonged periods of time without significant degradation of fiber strength, fabric integrity, and protection of the user. In some cases, a fabric having a continuous operating temperature of 400° F. may be exposed to brief periods of heat at higher temperatures without significant degradation. The presently accepted standard for continuous operating temperature in the auto racing industry rates fabrics as being "flame retardant" if they have a continuous operating temperature of between 375° F. to 600° F.

The term "fire retardant" refers to a fabric, felt or yarn that is self extinguishing. The term "nonflammable" refers to a fabric, felt or yarn that will not bum.

The term "Thermal Protective Performance" (or "TPP") relates to a fabric's ability to provide continuous and reliable protection to a person's skin beneath a fabric when the fabric is exposed to a direct flame or radiant heat. The TPP measurement, which is derived from a complex mathematical formula, is often converted into an SFI rating, which is an approximation of the time it takes before a standard quantity of heat causes a second degree burn to occur.

The term "SFI Rating" is a measurement of the length of time it takes for someone wearing a specific fabric to suffer a second degree burn when the fabric is exposed to a standard temperature. The SFI Rating is printed on a driver's suit. The SFI Rating is not only dependent on the number of fabric layers in the garment, but also on the LOI, continuous operating temperature and TPP of the fabric or fabrics from which a garment is manufactured. The standard SFI Ratings are as follows:

| SFI Rating | Time to Second Degree Burn |
|---|---|
| 3.2A/1 | 3 Seconds |
| 3.2A/3 | 7 Seconds |
| 3.2A/5 | 10 Seconds |
| 3.2A/10 | 19 Seconds |
| 3.2A/15 | 30 Seconds |
| 3.2A/20 | 40 Seconds |

A secondary test for flame retardance is the after-flame test, which measures the length of time it takes for a flame retardant fabric to self extinguish after a direct flame that envelopes the fabric is removed. The term "after-flame time" is the measurement of the time it takes for a fabric to self extinguish. According to SFI standards, a fabric must self extinguish in 2.0 seconds or less in order to pass and be certifiably "flame retardant".

The term "tensile strength" refers to the maximum amount of stress that can be applied to a material before rupture or failure. The "tear strength" is the amount of force required to tear a fabric. In general, the tensile strength of a fabric relates to how easily the fabric will tear or rip. The tensile strength may also relate to the ability of the fabric to avoid becoming permanently stretched or deformed. The tensile and tear strengths of a fabric should be high enough so as to prevent ripping, tearing, or permanent deformation of the garment in a manner that would significantly compromise the intended level of thermal protection of the garment.

The term "abrasion resistance" refers to the tendency of a fabric to resist fraying and thinning during normal wear. Although related to tensile strength, abrasion resistance also relates to other measurements of yarn strength, such as shear strength and modulus of elasticity, as well as the tightness and type of the weave or knit.

The term "earn", as used in the specification and appended claims, refers to a blend of individual strands of fibers that have been formed by, e.g., "carding" one or more types of "staple fibers". Most yarns comprise two or more individual threads or strands that have been twisted, spun or otherwise joined together to form a bundle of strands. This allows each strand, such as a strengthening fiber strand, to impart its unique properties along the entire length of the yarn. The individual strands within the yarn maybe formed from a single type of staple fiber, or they may comprise a blend of two or more different types of staple fibers.

The term "fabric", as used in the specification and appended claims, shall refer to one or more different types of yarns that have been woven, knitted, or otherwise assembled into a desired protective layer.

The term "felt", as used in the specification and appended claims, shall refer to a more random bundle of strands typically formed by a needle punch process. While typically weaker than fabrics comprising knitted or woven yarns, felts are usually superior in dispersing heat energy due to the increased randomness of the strands and the increased space between the strands. In addition, felts are superior in minimizing heat transfer.

The term "fibrous blend", as used in the specification and appended claims, shall refer to yarns and felts that include a mixture of oxidized polyacrylonitrile fibers and at least one strengthening fiber as well as fabrics knitted, woven or otherwise assembled from such yarns. The term "fibrous blend" shall also refer to individual strands formed by carding a mixture of oxidized polyacrylonitrile staple fibers and at least one strengthening staple fiber. The term "fibrous blend" shall not include fabrics which consist exclusively of distinct layers formed from pure oxidized polyacrylonitrile yarns and pure strengthening fiber yarns. However, the term "fibrous blend" shall encompass any fabric that includes the inventive yarns, fabrics, felts or strands regardless of the existence of other strands, yarns or fabrics known in the art within the article of manufacture.

III. YARNS

The yarns according to the present invention combine the tremendous fire retardant and heat resistant characteristics of oxidized polyacrylonitrile fibers with the strengthening and abrasion resistance offered by one or more additional fibers which are typically much stronger, but less fire retardant and heat resistant, compared to oxidized polyacrylonitrile fibers. These additional fibers maybe referred to as "strengthening fibers". The yarns may include other components as desired to import other desired properties.

The yarns according to the invention may be manufactured using virtually any yarn-forming process known in the art. However, the yarns are preferably manufactured by a processes known as cotton spinning or stretch broken spinning.

A. Oxidized Polyacrylonitrile Fibers.

The oxidized polyacrylonitrile fibers within the scope of the invention may comprise any known oxidized polyacrylonitrile fiber known in the art. In a preferred embodiment, the oxidized polyacrylonitrile fibers are obtained by heating polyacrylonitrile fibers in a cooking process between about 180° C. to about 300° C. for at least about 120 minutes. This heating/oxidation process is where the fibers receive their initial carbonization. Preferred oxidized polyacrylonitrile fibers will have an LOI of about 50–65. In most cases, such oxidized polyacrylonitrile may be considered to be nonflammable.

Examples of suitable oxidized polyacrylonitrile fibers include LASTAN, manufactured by Ashia Chemical in Japan, PYROMEX, manufactured by Toho Rayon in Japan, PANOX, manufactured by SGL, and PYRON, manufactured by Zoltek.

In general, it is believed that fabrics including oxidized polyacrylonitrile fibers will resist burning, even when exposed to intense heat or flame exceeding 3000° F., because the oxidized polyacrylonitrile fibers carbonize and expand, thereby eliminating any oxygen content within the fabric necessary for combustion of the more readily combustible strengthening fibers.

In order to achieve a high level of fire retardance, heat resistant and insulation ability, while providing adequate strength and abrasion resistance, it is desirable to maximize the quantity of oxidized polyacrylonitrile fibers within the yarn, while using only the minimum amount of strengthening fibers necessary to impart adequate strength. It has been found, for example, that for every 1% of p-aramid fibers that are blended with oxidized polyacrylonitrile fibers, the strength of the resulting yarn increases by about 10%. Thus, even though yarns containing pure oxidized polyacrylonitrile fibers are generally too weak to be used in the manufacture of fire retardant and heat resistant fabrics, yarns containing even a small percentage of strengthening fibers, and fabrics manufactured therefrom, have been found to be surprisingly strong, tear resistant, durable and abrasion resistant.

In this way it is possible to achieve a surprising synergy of desired properties, such as adequate strength and improved softness and comfort, while maximizing the desired fire retardance and heat resistance properties. Whereas conventional fire retardant fabrics may have adequate, or even superior, initial strength when maintained at or below their continuous operating temperatures, the physical integrity of such fabrics can be quickly compromised when they are exposed to temperatures exceeding their continuous operating temperature. In essence, the extremely high initial strength of such fabrics is wasted and becomes irrelevant when such fabrics are subjected to the high temperature conditions against which the fabrics were intended to afford protection.

In contrast to conventional thinking, the inventors now recognize that it is far better to manufacture fabrics that may have lower initial strength, but which will reliably maintain their strength over time, even when exposed to the most extreme conditions of fire and heat. Moreover, by relying on the fire retardance and heat resistance properties inherent in oxidized polyacrylonitrile fibers, rather than relying on the treatment of less fire retardant fabrics with fire retardant chemicals, the fabrics manufactured according to the present invention will retain most, if not all, of their fire retardant and heat resistant qualities over time. In this way, the user of a fire retardant and heat resistant garment manufactured according to the present invention will have the assurance that the garment will impart the intended high level of fire retardance and heat resistance over time, even after the garment has been repeatedly laundered, exposed to UV radiation (e.g. sun light), or splashed with solvents or other chemicals that might otherwise reduce the fire retardance of treated fabrics.

In general, where it is desired to maximize the flame retardance and heat resistance of the fabrics made therefrom, the inventive yarns according to the invention will include oxidized polyacrylonitrile fibers in an amount in a range from about 85.5% to about 99.9% by weight of the fibers in the yarn, preferably in an amount in a range from about 86% to about 99.5% by weight of the fibers in the yarn, more preferably in an amount in a range from about 87% to about 99% by weight of the fibers in the yarn, and most preferably in range from about 90% to about 97% by weight of the fibers in the yarn. These same preferred ranges generally apply to felts as well.

By maximizing the quantity of oxidized polyacrylonitrile fibers relative to the quantity of the strengthening fibers, it is possible to obtain yarns and fabrics that possess superior fire retardant properties, higher heat resistance, lower heat transference, and improved durability when exposed to constant heat or bursts of high heat, together with adequate strength and abrasion resistance, improved softness, better breathability, improved moisture regain, increased flexibility and comfort, and other performance criteria compared to conventional fire retardant fabrics presently available in the market.

The foregoing ranges are understood as being generally applicable and preferable when manufacturing yarns that include a blend of oxidized polyacrylonitrile fibers and one or more strengthening fibers. Nevertheless, because different strengthening fibers that may be blended with the oxidized polyacrylonitrile fibers may have greatly varying levels of fire retardance, heat resistance and strength, it may be possible to incorporate more of such strengthening fibers in the case where a particular type of fiber has relatively high fire retardance and heat resistance. For example, in the case where p-aramid, which has a relatively high LOI, TPP and continuous operating temperature compared to other strengthening fibers, is used primarily or exclusively as the strengthening fiber within the yarn, it maybe possible to increase the amount of such fiber. In fact, fabrics having adequate fire retardance and heat resistance have been manufactured from yarns that include as low as 80% oxidized polyacrylonitrile fibers and as high as 20% p-aramid fibers by weight of the fibers in the yarn.

Depending on the particular application, particularly where the overwhelmingly superior fire retardance and heat resistance properties of the fabrics of the present invention are less important, such as where the expected operating temperature is within a defined range that would permit somewhat lower fire retardance and heat resistance, and also in the case where it may be desirable to further increase the strength and abrasion resistance of the fabric, such as where the person and garment will be exposed to more rigorous physical abuse, it may be permissible in some cases to further increase the quantity of strengthening fibers within the yarn. In some cases, it may even be permissible to reduce the quantity of oxidized polyacrylonitrile fibers to 75%, 70%, or even as low as 60% by weight of the fibers within the yarn. In those cases where the quantity of oxidized polyacrylonitrile fibers is less than 85.5% by weight of the fibers within the yarn, it will be preferable to include only a single additional strengthening fiber, such as p-aramid, which itself has good fire retardance and heat resistance characteristics.

B. Strengthening Fibers.

The strengthening fibers that may be incorporated within the yarns of the present invention may comprise any fiber known in the art. In general, preferred fibers will be those which have a relatively high LOI and TPP compared to natural organic fibers such as cotton, although such fibers do not presently have nearly the LOI of oxidized polyacrylonitrile fibers. Accordingly, the strengthening fibers will preferably have an LOI greater than about 20.

Strengthening fibers within the scope of the invention include, but are not limited to, polybenzimidazole (PBI), polyphenylene-2,6-benzobisoxazole (PBO), modacrylic p-aramid, m-aramid, polyvinyl halides, wool, fire resistant polyesters, fire resistant nylons, fire resistant rayons, cotton, and melamine. By way of comparison, the LOI's of selected fibers are as follows:

| | |
|---|---|
| PBI | 35–36 |
| Modacrylic | 28–32 |
| m-Aramid | 28–36 |
| p-Aramid | 27–36 |
| Wool | 23 |
| Polyester | 22–23 |
| Nylon | 22–23 |
| Rayon | 16–17 |
| Cotton | 16–17 |

Examples of p-aramids are KEVLAR, manufactured by DuPont, TWARON, manufactured by Twaron Products BB, and TECKNORA, manufactured by Teijin. Examples of m-aramids include NOMEX manufactured by DuPont, CONEX, manufactured by Teijin, and P84, an m-aramid yarn with a multi-lobal cross-section made by a patented spinning method manufactured by Inspec Fiber. For this reason P84 has better fire retardance properties compared to NOMEX.

An example of a PBO is ZYLON, manufactured by Toyobo. An example of a melamine fiber is BASOFIL. An example of a fire retardant or treated cotton is PROBAN, manufactured by Westex, another is FIREWEAR.

In general, where it is desired to maximize the flame retardance and heat resistance of the fabrics made therefrom, it will be preferable to minimize the amount of strengthening fibers that are added to the yarn. In particular, it is preferable in such cases to add just enough of the strengthening fibers so as to satisfy the strength and abrasion resistance. In this way, the yarns will not have wasted or excess initial strength. Moreover, by maximizing, the flame retardance and heat resistance of the fabrics made from the inventive yarns, whatever strength and abrasion resistance possessed by the fabrics initially will be more reliably maintained in the case where the fabric is exposed to intense flame or radiant heat. This better preserves the integrity and protective properties of the fabric when the need for strength, integrity and protection against fire and heat are most critical.

Accordingly, where it is desired to maximize the flame retardance and heat resistance of the fabrics made therefrom, the inventive yarns according to the invention will include strengthening fibers in an amount in a range from about 0.1% to about 14.5% by weight of the fibers in the yarn, preferably in an amount in a range from about 0.5% to about 14% by weight of the fibers in the yarn, more preferably in an amount in a range from about 1% to about 13% by weight of the fibers in the yarn, and most preferably in an amount in a range from about 3% to about 10% by weight of the fibers in the yarn.

Nevertheless, because different strengthening fibers that may be blended with the oxidized polyacrylonitrile fibers may have greatly varying levels of fire retardance, heat resistance and strength, it may be possible to incorporate more of such strengthening fibers in the case where a particular type of fiber has relatively high fire retardance and heat resistance. For example, in the case where p-aramid, which has a relatively high LOI, TPP and continuous operating temperature compared to other strengthening fibers, is used primarily or exclusively as the strengthening fiber within the yarn, it may be possible to increase the amount of such fiber beyond the preferred low limit of about 14.5% by weight of the fibers within the yarn. In fact, fabrics having adequate fire retardance and heat resistance have been manufactured from yarns that include as low as 80% oxidized polyacrylonitrile fibers and as high as 20% p-aramid fibers by weight of the fibers in the yarn.

Depending on the particular application, particularly where the overwhelmingly superior fire retardance and heat resistance properties of the fabrics of the present invention are less important, such as where the expected operating temperature is within a defined range that would permit somewhat lower fire retardance and heat resistance, and also in the case where it may be desirable to further increase the strength and abrasion resistance of the fabric, such as where the person and garment will be exposed to more rigorous physical abuse, it may be permissible in some cases to further increase the quantity of strengthening fibers within the yarn. In some cases, it may even be permissible to increase the quantity of strengthening fiber within the yarn to 25%, 30%, or even as high as 40% by weight of the fibers within the yarn, in order to provide a garment having extremely high initial strength and abrasion resistance. In those cases where the quantity of strengthening fiber is greater than about 14.5% by weight of the fibers within the yarn, it has been found preferable to include only a single additional type of strengthening fiber, such as p-aramid, PBI or modacrylic in order to maximize strength and fire retardance.

C. Other Components.

In addition to the oxidized polyacrylonitrile fibers and strengthening fibers, it is certainly within the scope of the invention to add additional components to the yarns according to the invention. These include other fibers that may be added in order to provide additional properties, such as color or dyability, as well as sizing agents, flame retardant chemicals, and the like. Treatments such as sizing agents and flame retardant chemicals may advantageously be introduced into the finished fabric or article of manufacture as well.

IV. FIRE RETARDANT AND HEAT RESISTANT FABRICS AND ARTICLES OF MANUFACTURE

The inventive yarns manufactured according to the invention may be formed into a wide variety of different types of fabrics and articles of manufacture according to manufacturing procedures known in the art of textiles and garments. The yarns may be woven or otherwise assembled using any process known in the art to manufacture a wide variety of different fabrics. For example, a suitable knitting process if the Ne 20/1 knitting process. These include, but are not limited to, clothing, jump suits, gloves, socks, blankets, protective head gear, linings, insulating fire walls, and the like.

In general, the fabrics made according to the invention can be tailored to have specific properties and satisfy desired performance criteria Some of the improved properties possessed by the yarns and fabrics of the present invention include, but are not limited to, extremely high LOI, continuous operating temperature and TPP values, which are the standard measurements for fire retardance, heat resistance and thermal protection (or insulation ability), respectively, while also performing equally well or better in the other important performance criteria, such as softness, comfort, flexibility, breathability and water regain.

As stated above, the maximum continuous operating temperature according to SFI standards is 600° F. However, the leading fire retardant fabrics presently available in the market bum, begin to shrink while charring, then crack and decompose when exposed to a temperature of 600° F. This all occurs in about 10 seconds, which is hardly enough time for a person wearing such fabrics to safely remove himself or herself from the heat source before suffering bums, or at least without permanent damaging the fire retardant garment made from such fabrics. Under flammability testing, the leading fire retardant fabrics will ignite. They also have problems passing the shrinkage test.

When subjected to the same conditions as those described above, the presently preferred fabric made according to the present invention is not affected in any way. The preferred fabric even disperses or reflects the heat energy away from the fabric. When a direct flame is directed to a layer of the preferred fabric, it takes about 60 seconds for the heat will start to penetrate the next layer of fabric. The preferred fabric will not ignite or burn, even when exposed to temperatures exceeding 2600° F. for over 120 seconds. Moreover, the preferred fabric completely resists shrinkage. All of the foregoing contribute to the fabric's having by far the highest TPP of any known fire retardant fabric presently available on the market. The presently preferred fabric will undoubtedly cause the SFI standards for fire retardance and heat resistance to be raised dramatically.

An important feature of the present invention is the use of yarns that include oxidized polyacrylonitrile fibers, which are known to have extremely high fire retardance, heat resistance and insulation ability. However, oxidized polyacrylonitrile fibers are known to be generally too weak to be used by themselves in manufacturing woven or knitted fabrics that will have even minimal strength and abrasion resistance. For this reason, pure oxidized polyacrylonitrile is mainly used in the manufacture of filters, insulating felts, or other articles where tensile strength and abrasion resistance are not important criteria. In the case of clothing to be worn over long periods of time by persons such as race car drivers, fire fighters and the like, it is important for the fire retardant fabric to be strong, durable and abrasion resistant in order to provide a reliable barrier to heat and fire. For this reason, oxidized polyacrylonitrile must be blended with strengthening fibers in order to yield yarns and fabrics having adequate strength, durability and abrasion resistance.

This is a departure from, e.g., U.S. Pat. No. 6,021,523 to Vero, which discloses a heat and abrasion resistant woven glove in which a layer of pure Kevlar® strands are woven together with layer of pure oxidized polyacrylonitrile strands in an attempt to obtain the strength and abrasion resistance of Kevlar, on the one hand, and the heat resistance of oxidized polyacrylonitrile, on the other. The Kevlar strands 15 are positioned so as to be mainly on the outer exposed surface of the glove, while the oxidized polyacrylonitrile strands are positioned on the inside between the Kevlar and the person's hand. In this way, the interwoven Kevlar strands on the outer surface are intended to provide high abrasion resistance, while providing some heat resistance, while the interwoven but weaker oxidized polyacrylonitrile strands are intended to provide the bulk of the heat resistance.

The problem with the Vero design is that the Kevlar layer is vulnerable to heat degradation over time since Kevlar possesses only moderate LOI, TPP and continuous operating temperature ratings. Even moderate heat (i.e. 600° F.) can destroy the physical integrity of the Kevlar. Once the physical integrity of the protective Kevlar layer has been compromised, the substantially weaker and less abrasion resistant oxidized polyacrylonitrile strands become highly vulnerable to physical degradation, such as by tearing, ripping or abrading. Even a small hole formed in the heat resistant oxidized polyacrylonitrile layer may seriously compromise the intended heat resistance of the glove.

U.S. Pat. No. 4,865,906 to Smith, Jr. discloses yarns containing a blend of oxidized polyacrylonitrile fibers for fire retardance and at least two additional fibers for added strength. Whereas the yarns disclosed in Smith, Jr. would be expected to be have greater strength compared to pure oxidized polyacrylonitrile, and greater flame retardance and heat resistance compared to pure Kevlar, Smith, Jr. does not teach the manufacture of yarns having more than 85% oxidized polyacrylonitrile fibers. In fact, Smith, Jr. expressly teaches against the manufacture and use of yarns having 90% oxidized polyacrylonitrile on the grounds that such yarns are prone to "excessive flaming".

Contrary to both Vero and Smith, Jr., it has now been found that the highest degree of fire retardance and heat resistance can be obtained by manufacturing fabrics from yarns which incorporate more than 85% oxidized polyacrylonitrile fibers, together with at least one other fiber for increased strength and abrasion resistance. Moreover, contrary to Smith, Jr., it has been found that yarns can be manufactured from a blend of oxidized polyacrylonitrile fibers and only one single type of strengthening fibers, such as p-aramid. In cases where oxidized polyacrylonitrile fibers are blended with only one single type of strengthening fiber in the manufacture of a yarn, the concentration of oxidized polyacrylonitrile fibers can be in a broad range from about 60% to about 99.9% by weight of the yarn.

The yarns and fabrics according to the invention preferably have an LOI of at least about 40, more preferably greater than about 45, and most preferably greater than about 50. The yarns and fabrics preferably have a continuous operating temperature of at least about 750° F., more preferably at least about 1000° F., and most preferably at least about 1500° F.

V. EXAMPLES OF THE PREFERRED EMBODIMENTS

The following examples are presented in order to more specifically teach the methods of forming yarns and fabrics according to the present invention. The examples include various fibrous blends, used in conjunction with different manufacturing processes, in order to create the yarns and fabrics of the present invention. Those examples that are written in the past tense are actual working examples that have been carried out. Those examples that are written in the present tense are to be considered hypothetical or "prophetic" examples, although they are based on, or have been derived from, actual fibrous blends and fabrics that have been manufactured and tested.

EXAMPLE 1

A fire retardant and heat resistant yarn incorporating 92% by weight oxidized polyacrylonitrile fibers and 8% p-aramid fibers was manufactured using a cotton spinning machine. The yarn was then woven into a fire retardant and heat resistant fabric using a rapier weaning machine.

The resulting fabric was soft and supple and more comfortable to the touch compared to leading fire retardant fabrics such as Nomex, which is the industry standard. In addition, not only did the fabric have adequate strength and abrasion resistance due to the inclusion of p-aramid fibers for strengthening, the fabric was completely resistant to heat damage at 600° F. and much higher temperatures. In fact, a single layer of the fabric was found to at least partially disperse the heat rather than allowing it to penetrate through the fabric, thus providing far superior protection against burns compared to the leading fabric. Moreover, the fabric was completely resistant to ignition when exposed to a direct flame from a propane torch.

In fact, a test was performed in which a piece of the fabric was rotated around an axis while being continuously exposed to the tip of a flame from a propane torch. The temperature of the tip of the flame was approximately 3000° F. Even after 12 hours of being exposed to the flame, the fabric completely maintained its structural integrity. The only noticeable effect was a slight amount of discoloration in the area that was subject to direct touch by the flame of the propane torch.

In order to demonstrate the heat dispersing and anti-bum properties of even a single layer of the fabric, which was approximately 2 mm thick, one of the inventors a different times placed felt and knitted versions the fabric over his wrist and directed the tip of a butane torch directly onto the fabric. The temperature of the tip of the flame was approximately 2600° F. The fabric glowed red in the area and surrounding vicinity of where the tip of the flame touched the fabric. Even though the fabric looked hot, the underside of the fabric remained cool to the touch for up about 60 seconds while exposed to the tip of the flame, thus completely protecting the inventor from sustaining a burn, or even feeling pain, for up to about 60 seconds. Of course, a garment having multiple layers of this fabric, or one or more layers of the fabric layered with one or more layers of conventional fabrics, would provide far greater heat resistance and protection against bums.

A race car jump suit was manufactured using three layers of the aforementioned fabric, together with layers of Nomex in areas where increased flexibility were desired, such as the shoulder area. The only reason Nomex was used was because a flexible knit of the yarn had not yet been manufactured at this time. The jump suit was worn by a race car driver in order to test the fire retardance and heat resistance of the inventive fabric. As luck would have it, the race car driver, by pure happenstance, was the victim of a fiery crash. As he ran from the car he was engulfed in flames, fuel having penetrated and absorbed into the jump suit and then ignited. After managing to roll in the gravel and, with the help of others, extinguish himself, he realized that he suffered no burns and was completely unscathed by the event. This test convincingly demonstrated the tremendous superiority of the jump suit manufactured using the fabric of Example 1.

An inspection of the jump suit after the blaze revealed that the fabric of Example 1 was virtually unscathed and unharmed by the burning action of the gasoline soaked into the fabric. There were very no areas where the fabric actually opened up as a result of the burning gasoline and in which the driver was exposed direct heat. There were a few minor rips solely due to the abrasive action of the gravel as the driver was rolling around trying to extinguish himself The most noticeable damage to the jump suit was to the layer of Nomex, which had a hole melted right through the fabric. Had the jump suit comprised purely, or even primarily, Nomex, the driver may have suffered serious burns under the circumstances.

The yarn of Example 1 was also knitted, twilled and felted into alternative fabrics using convention equipment known in the textile art.

EXAMPLE2

A fire retardant and heat resistant yarn incorporating 93% by weight oxidized polyacrylonitrile fibers and 7% p-aramid fibers was manufactured using a cotton spinning machine. The yarn was then knitted or woven into a variety of fire retardant and heat resistant fabrics.

The resulting fabric was similar to the fabric made according to Example 1, except that it had even higher fire retardance and heat resistance properties. Although the tensile strength and abrasion resistance were slightly lower than those of the fabric of Example 1, they were found to be generally adequate for most purposes.

EXAMPLES 3–10

Fire retardant and heat resistant yarns were manufactured having the following concentrations of oxidized polyacrylonitrile fibers (0Pan) and p-aramid (Kevlar) according to the method described in Example 1:

| Example | O-Pan | Kevlar |
|---|---|---|
| 3 | 90% | 10% |
| 4 | 91% | 9% |
| 5 | 94% | 6% |
| 6 | 95% | 5% |
| 7 | 96% | 4% |
| 8 | 97% | 3% |
| 9 | 98% | 2% |
| 10 | 99% | 1% |

The yarns according to Examples 3–10 were then knitted or woven into a variety of fire retardant and heat resistant fabrics. These examples, in combination with Examples 1 and 2, demonstrated that incremental increases of 1% of the p-aramid content increased the strength of the resulting yarn by increments of approximately 10%. As the concentration of the oxidized polyacrylonitrile fibers was increased, the fire retardant and heat resistant properties of the fabric increased.

EXAMPLE 11

A fire retardant and heat resistant yarn incorporating 80% by weight oxidized polyacrylonitrile fibers and 20% p-aramid fibers (Kevlar) was manufactured using a cotton spinning machine. The yarn was then knitted or woven into a variety of fire retardant and heat resistant fabrics.

The resulting fabric was similar to the fabrics made according to Examples 1–10, except that it had somewhat lower fire retardance and heat resistance properties. On the other hand, the fabrics made according to Example 11 had superior tensile strength and abrasion resistance properties.

EXAMPLES 12–15

Fire retardant and heat resistant yarns are manufactured having the following concentrations of oxidized polyacrylonitrile fibers (0-Pan) and p-aramid (Kevlar) according to the method described in Example 1:

| Example | O-Pan | Kevlar |
|---|---|---|
| 12 | 60% | 40% |
| 13 | 65% | 35% |
| 14 | 70% | 30% |
| 15 | 75% | 25% |

The yarns according to Examples 12–15 are knitted or woven into a variety of fire retardant and heat resistant fabrics. As the concentration of the oxidized polyacrylonitrile fibers is decreased, the fire retardant and heat resistant properties of the fabric likewise decrease. Depending on the intended use, fire retardant and heat resistant fabrics having as little as 60% O-Pan may provide adequate protection for the user.

EXAMPLE 16

A fire retardant and heat resistant yarn incorporating 99.5% by weight oxidized polyacrylonitrile fibers and 0.5% p-aramid fibers is manufactured according to Example 1. The yarn is then knitted or woven into a variety of fire retardant and heat resistant fabrics.

The resulting fabrics have extremely high fire retardance and heat resistance properties, but only weak to moderate strength. Even so, the fabrics have significantly greater strength than fabrics comprising pure oxidized polyacrylonitrile fibers. Such fabrics are better suited for uses that not have high requirements of tensile strength and abrasion resistance, such as fire walls or heat resistance layers surrounded by more durable fabrics.

EXAMPLE 17

A fire retardant and heat resistant yarn incorporating 99.9% by weight oxidized polyacrylonitrile fibers and 0.1% p-aramid fibers is manufactured according to Example 1. The yarn is then knitted or woven into a variety of fire retardant and heat resistant fabrics.

The resulting fabrics have extremely high fire retardance and heat resistance properties, but relatively weak strength. Even so, the fabrics have measurably greater strength than fabrics comprising pure oxidized polyacrylonitrile fibers. Such fabrics are better suited for uses that not have high requirements of tensile strength and abrasion resistance, such as fire walls or heat resistance layers surrounded by more durable fabrics.

EXAMPLE 18

Any of the foregoing yarns and fabrics is modified by replacing some or all of the p-aramid with one or more of the following types of strengthening fibers: polybenzimidazole fibers, modacrilic fibers, m-aramid fibers, polyvinyl halide fibers, wool fibers, fire resistant polyesters fibers, fire resistant nylon fibers, fire resistant rayon fibers, cotton fibers, Nomex fibers, Proban fibers, Basofil fibers, and Panox fibers.

COMPARATIVE TESTING

The Thermal Protection Properties (TPP) of single layers of fabrics and felts manufactured according to the present invention were tested and compared to those of leading flame retardant and beat resistance fabrics. The TPP test was carried out using standard testing procedures known in the art. The inventive fabrics used in this comparative test were manufactured by either weaving or knitting a yarn that included a blend of oxidized polyacrylonitrile and p-aramid fibers.

The blends according to the present invention will be identified by the respective concentrations of oxidized polyacrylonitrile and p-aramid fibers. For example, a blend containing 92% oxidized polyacrylonitrile and 8% p-aramid fibers will be referred to as a 92/8 blend. Whether the fabric is a weave, knit or felt will also be indicated.

The NOMEX III is an m-aramid, while FIREWEAR and PROBAN are both fire retardant cotton fabrics. The weight of the fabric is given in ounces. In order to standardize the results, the ratio of the TPP to the weight of the fabric will be given. The results obtained by the comparative testing are as follows:

| Comparative Test | Fabric | Weight | TPP (cal/cm$^2$) | TPP/Weight |
|---|---|---|---|---|
| 1 | 93/7 weave | 8 | 15 | 1.875 |
| 2 | 99/1 felt | 5.9 | 29 | 4.915 |
| 3 | 98/2 knit | 5.4 | 9.8 | 1.815 |
| 4 | 98/2 knit | 17 | 30.4 | 1.788 |
| 5 | 98/2 knit | 8.3 | 15 | 1.807 |
| 6 | 97/3 weave | 6.5 | 14.4 | 2.215 |
| 7 | 98/2 knit | 11.9 | 19.1 | 1.605 |
| 8 | 92/8 knit | 12.5 | 17.5 | 1.400 |
| 9 | 93/7 knit | 6.2 | 14.1 | 2.274 |
| 10 | 92/8 knit | 6.3 | 13.3 | 2.111 |
| 11 | FIREWEAR | 9.26 | 9.5 | 1.026 |
| 12 | PROBAN | 9.26 | 10.6 | 1.145 |
| 13 | NOMEX III | 6.61 | 8.47 | 1.281 |

As can be seen, the TPP/Weight ratios of the inventive fabrics ranges from 1.4 up to 2.274, while the leading fire retardant fabrics had considerably lower TPP/Weight ratios of about 1 to about 1.3.

VI. SUMMARY

From the foregoing, the invention provides improved fire retardant and heat resistant yarns, fabrics, felts and other fibrous blends which are able to satisfy most, if not all, of the desired performance criteria.

The invention further provides improved fibrous blends that yield fire and flame retardant yarns, fabrics, felts and other fibrous blends that are able to satisfy a wider range of performance criteria compared to conventional fire retardant fabrics and other fibrous blends.

The invention also provides fire retardant yarns, fabrics, felts and other fibrous blends that have higher continuous operating temperatures, higher LOI and TPP ratings, and improved resistance to heat transfer, while having adequate strength, including tensile strength and abrasion resistance, as well as a softer, more flexible and comfortable feel when worn against a person's skin compared to conventional fire retardant fabrics and other fibrous blends.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A fire retardant and heat resistant fibrous blend comprising:

oxidized polyacrylonitrile fibers included in an amount in a range from about 85.5% to about 99.9% by weight of the fibrous blend; and at least one type of strengthening fibers blended with the oxidized polyacrylonitrile fibers in a manner so as to comprise a fibrous blend having increased strength and abrasion resistance compared to a yarn, fabric or felt consisting exclusively of said oxidized polyacrylonitrile fibers and included in an amount in a range from about 0.1% to about 14.5% by weight of the fibrous blend.

2. A flame and heat resistant fibrous blend as defined in claim 1, wherein the fibrous blend has an LOI of at least about 40.

3. A flame and heat resistant fibrous blend as defined in claim 1, wherein the fibrous blend has an LOI of at least about 45.

4. A flame and heat resistant fibrous blend as defined in claim 1, wherein the fibrous blend has an LOI of at least about 50.

5. A flame and heat resistant fibrous blend as defined in claim 1, wherein the fibrous blend has a continuous operating temperature greater than about 750° F.

6. A flame and heat resistant fibrous blend as defined in claim 1, wherein the fibrous blend has a continuous operating temperature greater than about 1000° F.

7. A flame and heat resistant fibrous blend as defined in claim 1, wherein the fibrous blend has a continuous operating temperature greater than about 1500° F.

8. A flame and heat resistant fibrous blend as defined in claim 1, wherein the fibrous blend includes oxidized polyacrylonitrile fibers in a range from about 86% to about 99.5% by weight of the yarn.

9. A flame and heat resistant fibrous blend as defined in claim 1, wherein the fibrous blend includes oxidized polyacrylonitrile fibers in a range from about 87% to about 99% by weight of the yarn.

10. A flame and heat resistant fibrous blend as defined in claim 1, wherein the fibrous blend includes oxidized polyacrylonitrile fibers in a range from about 90% to about 97% by weight of the yarn.

11. A flame and beat resistant fibrous blend as defined in claim 1, wherein the at least one additional type of fibers is at least one of polybenzimidazole, a polyphenylene-2,6-benzobisoxazole, modacrilic, p-aramid, m-aramid, a polyvinyl halide, wool, a fire resistant polyester, a fire resistant nylon, a fire resistant rayon, cotton, or melamine.

12. A flame and heat resistant fibrous blend as defined in claim 1, wherein the fibrous blend comprises a yarn.

13. A flame and heat resistant fibrous blend as defined in claim 12, wherein the yarn has been formed into a fabric by at least one of weaving, knitting, random placement, or layered placement of the yarn.

14. A flame and heat resistant fibrous blend as defined in claim 1, wherein the fibrous blend comprises at least a portion of an article of manufacture selected from the group consisting of clothing, a jump suit, a glove, a sock, a welding bib, a fire blanket, a floor board, padding, protective head gear, a lining, an undergarment, a cargo hold, bedding, mattress insulation, a drape, and an insulating fire wall.

15. A flame and heat resistant fibrous blend as defined in claim 1, wherein the fibrous blend comprises as least a portion of a felt.

16. A flame and heat resistant fibrous blend as defined in claim 1, wherein the fibrous blend includes at least one strand formed from a mixture of the oxidized polyacrylonitrile fibers and the at least one type of strengthening fibers.

17. A fire retardant and heat resistant fibrous blend consisting essentially of:

oxidized polyacrylonitrile fibers included in an amount in a range from about 60% to about 99.9% by weight of the fibrous blend; and a single type of strengthening fiber blended with the oxidized polyacrylonitrile fibers in a manner so as to comprise a fibrous blend having increased strength and abrasion resistance compared to a yarn, fabric or felt consisting exclusively of said oxidized polyacrylonitrile fibers and included in an amount in a range from about 0.1% to about 40% by weight of the fibrous blend.

18. A fire retardant and heat resistant fibrous blend as defined in claim 17, wherein the fibrous blend is at least one of a yarn, a strand, a fabric, or a felt.

19. A fire retardant and heat resistant yarn comprising:

oxidized polyacrylonitrile fibers included in an amount in a range from about 85.5% to about 99.9% by weight of the yarn; and at least one type of strengthening fibers blended with the oxidized polyacrylonitrile fibers in a manner so as to comprise a yarn having increased strength and abrasion resistance compared to a yarn consisting exclusively of said oxidized polyacrylonitrile fibers and included in an amount in a range from about 0.1% to about 14.5% by weight of the yarn.

20. A fire retardant and heat resistant yarns as defined in claim 19, wherein the oxidized polyacrylonitrile fibers are included in an amount in a range from about 87% to about 99% by weight of the yarn.

* * * * *

UNITED STATES PATENT AND TRADEMARK OFFICE

CERTIFICATE OF CORRECTION

PATENT NO. : 6,287,686 B1 
DATED : September 11, 2001
INVENTOR(S) : Tsai Jung Huang, William J. Hanyon and Michael R. Chapman It is certified that error appears in the above-identified patent and that said Letters Patent is hereby corrected as shown below:

Title page,
ABSTRACT,
Line 5, after "temperature" delete ","
Line 7, after "fibrous" delete ":"

Column 1,
Line 23, before "and even" change "bums" to -- burns --

Column 2,
Line 6, after "open up" change "rough" to -- through --

Column 3,
Line 29, before "(PBO)" change "6benzobisoxazole" to -- 6-benzobisoxazole --

Column 5,
Line 52, after "will not" change "bum" to -- burn. --

Column 6,
Line 42, after "term" change ""earn"," to -- "yarn," --

Column 11,
Line 38, after "market" change "bum" to -- burn --
Line 42, after "suffering" change "bums," to -- burns, --
Line 52, after "seconds" change "for" to -- before --

Column 12,
Line 22, after "strands" insert -- 14 --
Line 44, after "expected to" delete "be"

Column 13,
Line 51, after "dispersing and" change "anti-bum" to -- anti-burn --
Line 53, after "inventors" change "a" to -- at --
Line 54, after "versions" insert -- of --
Line 60, after "for up" insert -- to --
Line 67, after "against" change "bums" to -- burns --

UNITED STATES PATENT AND TRADEMARK OFFICE

CERTIFICATE OF CORRECTION

PATENT NO. : 6,287,686 B1 
DATED : September 11, 2001
INVENTOR(S) : Tsai Jung Huang, William J. Hanyon and Michael R. Chapman It is certified that error appears in the above-identified patent and that said Letters Patent is hereby corrected as shown below:

Column 14,
Line 21, before "areas" change "no" to -- few --
Line 23, after "exposed" insert -- to --
Line 25, after "himself" insert -- . --
Line 35, change "EXAMPLE2" to -- EXAMPLE 2 --
Line 52, after "fibers" change "(0Pan)" to -- (O-Pan) --

Column 16,
Line 3, before "not have" insert -- do --

Column 18,
Line 5, before "resistant" change "beat" to -- heat --
Line 7, before "polyphenylene-2" delete "a"
Line 25, after "comprises" change "as" to -- at --
Line 58, after "resistant" change "yarns" to -- yarn --

Signed and Sealed this

Twenty-fifth Day of June, 2002

*Attest:*

*Attesting Officer*

JAMES E. ROGAN
*Director of the United States Patent and Trademark Office*